United States Patent [19]

Gotanda

[11] Patent Number: 4,840,050

[45] Date of Patent: Jun. 20, 1989

[54] LOCK DEVICE WITH TRIGGER BOLT

[76] Inventor: Motohiro Gotanda, 1802-10, Nakabiyo, Abiko-shi, Chiba-ken, Japan

[21] Appl. No.: 36,615

[22] Filed: Apr. 10, 1987

[30] Foreign Application Priority Data

Apr. 14, 1986 [JP] Japan ..... 61-84350

[51] Int. Cl.[4] ..... E05B 63/14

[52] U.S. Cl. ..... 70/107; 70/279; 292/169.13; 292/254; 292/335

[58] Field of Search ..... 292/335, 169.14, 341.16, 292/341.17, 169.15, 254, 169.13; 70/107, 279, 277

[56] References Cited

U.S. PATENT DOCUMENTS

| | | | |
|---|---|---|---|
| 1,409,245 | 3/1922 | Segal | 70/107 |
| 3,672,714 | 6/1972 | Schultz | 70/107 X |
| 3,769,822 | 11/1973 | Yulkowski | 70/107 |
| 3,917,329 | 11/1975 | Fujiki et al. | 292/169.13 X |
| 4,389,061 | 6/1983 | Foshee | 292/169.14 |
| 4,529,234 | 7/1985 | Senften | 70/283 X |
| 4,583,382 | 4/1986 | Hull | 70/107 |
| 4,679,834 | 7/1987 | Gotanda | 292/254 X |

FOREIGN PATENT DOCUMENTS

| | | | |
|---|---|---|---|
| 136969 | 7/1901 | Fed. Rep. of Germany | 70/107 |
| 58-33348 | 7/1983 | Japan . | |

*Primary Examiner*—Lloyd A. Gall

*Attorney, Agent, or Firm*—Jordan and Hamburg

[57] ABSTRACT

The lock device comprises a locking portion and a fixing portion. The locking portion comprises a rotation lever mounted on a door side and turned by rotating a thumbturn or a key, a dead bolt engaging with the rotation lever and performing lock and release of the lock device by turning the rotation lever, a trigger bolt for locking the dead bolt, a rotating plate operating in a direction of draw in the dead bolt to the door side, and a latch bolt drawn in to the door side by the action of the rotating plate. The fixing portion comprises a strike mounted on a frame side of the door, a pressing lever for locking the dead bolt and pressing the trigger bolt onto the strike, means for causing the pressing lever to operate, and means for releasing press operation of the pressing lever and causing the trigger bolt to project to the door frame side.

17 Claims, 5 Drawing Sheets

LOCK DEVICE WITH TRIGGER BOLT

BACKGROUND OF THE INVENTION

The present invention relates to a lock device capable of opening a door, even in the case when a dead bolt is in a locked position, without using a key by releasing the locking condition of a trigger bolt from a door frame side by means of remote control.

Conventionally, in a lock device of a door comprising a dead bolt, a latch bolt, and a trigger bolt, the trigger bolt of the lock device is installed for the purpose of locking the latch bolt not the dead bolt. For this reason, in the case of the lock device having means for releasing the trigger bolt from the door frame side by remote control in the control room, when the door is closed in a state of temporary locking with the dead bolt unlocked, the locking condition of the trigger bolt for fixing the latch bolt can be released from the door frame side by remote control from the control room, and then a visitor can draw the latch bolt by turning the knob of the door and can open the door.

In the afore-mentioned conventional lock device, the trigger bolt is locked on the latch bolt. Therefore, in a state of locking the dead bolt regularly, when a visitor comes to the door and the manager of the control room releases the locking condition of the trigger bolt from the door frame side by remote control from the control room, the visitor can turn the knob from the external side and can draw in the latch bolt, but he cannot draw in the dead bolt. Consequently, there remains a problem to be settled that the door cannot be opened from the external side without employing the key for opening it.

For this reason, the visitor cannot open the door even though the trigger bolt is released by remote control in a state of locking the lock device regularly. Therefore, the manager of the control room has to go to the door and release the dead bolt. It is an inconvenient problem to be settled.

SUMMARY OF THE INVENTION

It is an object of the present invention to provide a lock device capable of opening the door from the external side without employing a key by remote control.

It is another object of the present invention to provide a lock device capable of opening the door from the external side without employing a key by releasing the locking condition of the dead bolt by remote control.

It is another object of the present invention to provide a lock device capable of opening a door from the external side without employing a key by releasing the locking condition of the trigger bolt from the door frame side by remote control in the state of locking the dead bolt regularly.

It is another object of the present invention to provide a lock device comprising a locking portion and a fixing portion; the locking portion comprising a rotation lever mounted on a door and turned by rotating a thumbturn from the internal side or turned by rotating a key from the external side, a dead bolt engaging with the rotation lever and performing lock and release of the lock device by turning the rotation lever, a trigger bolt for locking the dead bolt, a rotating plate having one end of an engaging piece engaging with the dead bolt and operating in a direction of drawing in the dead bolt into the door side by the action of rotation thereof, and a latch bolt engaging with another end engaging piece of the rotating plate and drawn in to the door side by the action of rotation thereof; the fixing portion comprising a strike mounted on a frame side of the door, a pressing lever for locking the dead bolt by drawing in the same to the door side while pressing the trigger bolt onto the strike, means for causing the pressing lever to operate, and means for releasing press operation of the pressing lever and causing the trigger bolt to project to the door frame side.

The above-mentioned features and other advantages of the present invention will be apparent from the following detailed description which goes with the accompanying drawings.

DESCRIPTION OF THE PREFERRED EMBODIMENTS

The lock device according to the present invention comprises a locking portion and a fixing portion. The locking portion comprises a rotation lever mounted on a door side and turned by rotating a thumbturn from the internal side or turned by rotating a key from the external side, a dead bolt engaging the rotation lever and performing lock and release of the lock device by turning the rotation lever, a trigger bolt for locking the dead bolt, a rotating plate having one end of an engaging piece engaging with the dead bolt and operating in a direction of drawing in the dead bolt to the door side by the action of rotation thereof, and a latch bolt engaging with another end engaging piece of the rotating plate drawn in to the door side by the action of rotation thereof. The fixing portion comprises a strike mounted on a frame side of the door, a pressing lever for locking the dead bolt by drawing in the same to the door side while pressing the trigger bolt onto the strike, means for causing the pressing lever to operate, and means for releasing press operation of the pressing lever and causing the trigger bolt to project to the door frame side.

In the present invention, the rotation lever is turned by rotating the thumbturn from the internal side and by rotating the key from the external side in order to release the locking condition of the dead bolt.

Furthermore, the rotating plate is rotated by turning the inner knob from the internal side and by turning the outer knob from the external side so that the locking member is released.

And further, in the case of operating by remote control, pressure of the pressing lever is released and the trigger bolt is caused to project to the door frame side in order to release the locking condition of the dead bolt. After that, the dead bolt and the locking member is released by turning the outer knob.

Figure 1:
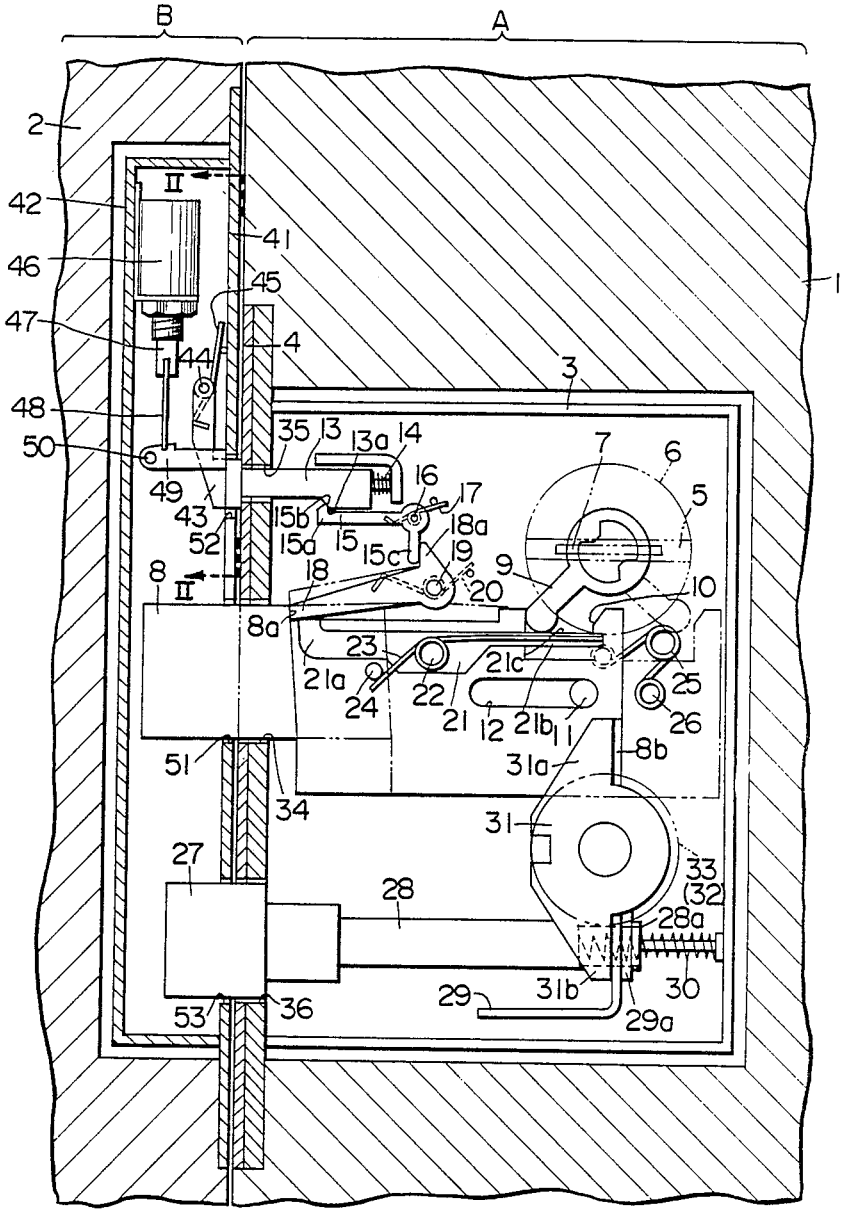
FIG. 1 is a partially broken side cross-sectional view showing one embodiment of the present invention.
Figure 2:
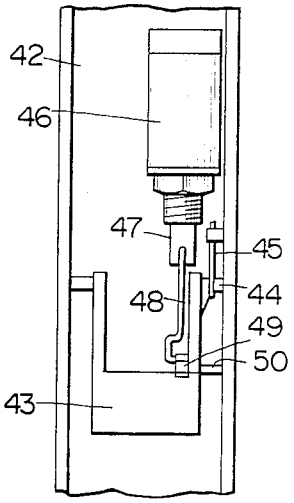
FIG. 2 is a cross-sectional view taken along the line II—II of FIG. 1 showing the case of removing a strike.

FIG. 1 is a partially broken side cross-sectional view for explaining an embodiment of the present invention. FIG. 2 is a cross-sectional view taken along the line II—II of FIG. 1. In those figures, A is a locking portion in which a locking device is mounted on a door 1, and B is a fixing portion in which a door-case 2 such as frame-work or the like is mounted thereon.

In the locking portion A, 3 is a case, 4 a front, 5 a thumbturn, 6 a cylinder, 7 a key, 8 a dead bolt, 9 a rotation lever turned by the thumbturn 5 or the key 7, and 10 an engaging groove for engaging with the rotation lever 9. The dead bolt 8 is formed so as to advance in a locking direction and recede in a releasing direction by turning the rotation lever 9. In the same portion, 11 is a guiding shaft installed in the case 3 for guiding the dead bolt 8, 12 a slit formed in the dead bolt 8, through which the guiding shaft 11 is loosely inserted, 13 a trigger bolt, 14 a spring for pressing the trigger bolt 13 for causing the trigger bolt 13 to project outside of the case 3, 15 an engaging lever loosely mounted on a shaft 16 fixed to the case 3 which comprises one end portion 15*a* having an inclined surface 15*b* and engages with the inclined surface 13*a* formed on the trigger bolt 13 and another end portion 15*c*, 17 a spring mounted on the fixed shaft 16 for energizing the engaging lever 15 in the clockwise direction, and 18 a stop lever for stopping the locked dead bolt 8 in order to prevent the same from moving in the releasing direction and being drawn in into the case 3. The lever 18 is loosely mounted on the shaft 19 fixed to the case 3. At the time of locking the lock device, the lever 18 is engaged on the step portion 8*a* of the dead bolt 8 and the end portion 18*a* of the lever 18 engages with the other end portion 15*c* of the engaging lever 15.

The numeral 20 represents a spring for energizing the stop lever 18 in the counter-clockwise direction, which is mounted on the fixed shaft 19, 21 an operation lever for operating the stop lever 18, which is loosely mounted on the fixed shaft 22 fixed on the dead bolt 8 and has one end portion 21*a* brought into direct contact with the stop lever 18 and another end portion 21*b* formed with a stop piece 21*c*, and 23 a spring for energizing the operation lever 21 in the counter-clockwise direction, one end of which is stopped on the stop piece 21*c* and another end of which is stopped on the fixed shaft 24 provided in the dead bolt 8. And further, the stop piece 21*c* formed by bending the operation lever 21 in a perpendicular to the drawing (FIG. 1) engages with the rotation lever 9. The numeral 25 represents a spring for keeping the dead bolt 8 at either of the locking position or the releasing position. The spring 25 is mounted on the fixed shaft 26 which is fixed on the dead bolt 8 at one end thereof and fixed on the case 3 at another end thereof. In the same figure, 27 is a latch bolt employed as the locking member, 28 a shaft unitarily formed with the latch bolt 27, 29 a tractor element for moving the latch bolt 27, 30 a spring for energizing the latch bolt 27 in such a direction as to project, the end portion of which is inserted into the hollow portion 28*a* formed in the shaft 28, and 31 a rotating plate. The rotating plate 31 rotates by turning the inner knob 32 and the outer knob 33. The piece 31*a* located at one end thereof engages with the engaging piece 8*b* of the dead bolt 8 and the piece 31*b* located at another end thereof engages with the guiding piece 29*a* of the tractor element 29. In the same figure, 34 is a through hole for the dead bolt 8, 35 a through hole for the trigger bolt 13, and 36 a through hole for the latch bolt 27.

In the fixing portion B, 41 is a strike mounted on the door frame 2, 42 a case, and 43 a lever for pressing the trigger bolt 13 which is loosely mounted on the shaft 44 fixed on case 42, as shown in FIG. 2. In FIGS. 1 and 2, 45 is a spring for pressing the lever 43 in the counter-clockwise direction, 46 a solenoid, 47 a plunger, 48 a connection bar, 49 a lever for causing the lever 43 to engage therewith, which is loosely mounted on the fixed shaft 50 fixed on the case 42, 51 a through hole for inserting the dead bolt 8, 52 a through hole for inserting the trigger bolt 13 and the lever 43, and 53 a through hole for inserting the latch bolt 27.

Next, the functional movement of the lock device is explained hereinafter.

FIG. 1 shows the condition of the lock device with the door 1 closed. The lever 43 is energized in the counter-clockwise direction by the action of the repulsive force of the spring 45 and also energized in the clockwise direction owing to the weight of the plunger 47 when the solenoid 46 doesn't operate. At this time, the lever 43 is kept horizontal and engaged with the lever 49 as shown in FIG. 1, and the trigger bolt 13 is drawn into the case 3. For this reason, since the inclined surface 15*b* of the lever 15 engages with the inclined surface 13*a* of the trigger bolt 13 by the action of the clockwise energizing force of the spring 17, the stop lever 18 is energized in the counter-clockwise direction so as to stop on the engaging step portion 8*a* of the dead bolt 8. Consequently, as the dead bolt 8 is fixed, the rotating plate 31 is also fixed. Therefore, the inner knob 32 and the outer knob 33 cannot be rotated in the releasing direction and thereby the door 1 cannot be opened. Moreover, although the rotating plate 31 rotates in the counter-clockwise direction by turning the inner knob 32 and the outer knob 33, the latch bolt 27 is only drawn into the case 3 on that occasion, and therefore the door 1 cannot be opened.

Figure 3:
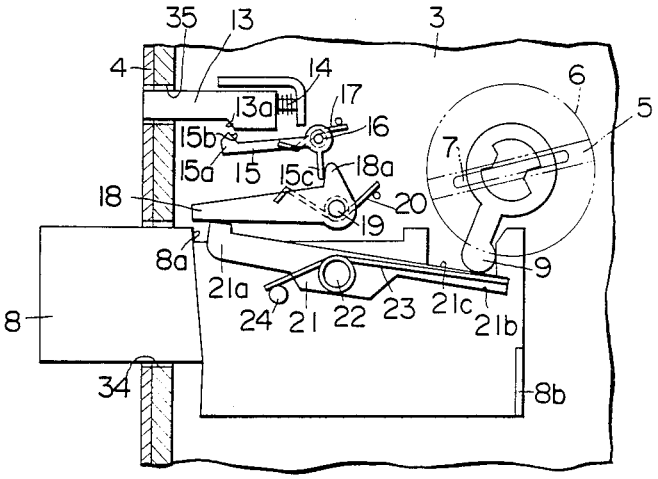
FIGS. 3 and 4 are explanation views showing the state after the operation shown in FIG. 1.

Next, the releasing operation performed by the inhabitant from the internal side is explained hereinafter. When the thumbturn 5 is rotated a little in the clockwise direction viewing from the internal side (in the counter-clockwise direction viewing from the external side of FIG. 1), the rotation lever 9 rotates and slides on the piece 21*c* of the operation lever 21 as shown in FIG. 3. At this time, since the operation lever 21 is pressed downward, it rotates in the clockwise direction and one end portion 21*a* thereof moves upward and presses the stop lever 18. As a result, the lever 18 rotates in the clockwise direction and thereby releases the stopped condition at the engaging step portion 8*a* of the dead bolt 8. At the same time, one end portion 18*a* of the stop lever 18 releases the press condition at another end portion 15*c* of the lever 15. By rotating the same in the counter-clockwise direction, the engaging condition at the respective inclined surfaces 13*a* and 15*b* is released. Consequently, the trigger bolt 13 turns out to be capable of projecting from the case 3.

Next, when the thumbturn 5 is rotated furthermore, the dead bolt 8 is drawn into the case 3 and released as shown by the two-dots-and-dash line of FIG. 1. Next, when the inner knob 32 is turned clockwise, the latch bolt 27 is drawn in into the case 3 and thereby the door 1 can be opened.

Next, the releasing operation performed by the key 7 from the external side is explained as follows. When the key 7 is inserted into the cylinder 6 and turned a little counter-clockwise, the trigger bolt 13 is released at first the same action as mentioned above. When the key 7 is turned furthermore, the dead bolt 8 is drawn in and the engaging condition thereof is released. Next, when the outer knob 33 is turned counter-clockwisely, the latch bolt 27 is drawn in and the engaging condition thereof is released and thereby the door 1 can be opened.

Figure 4:
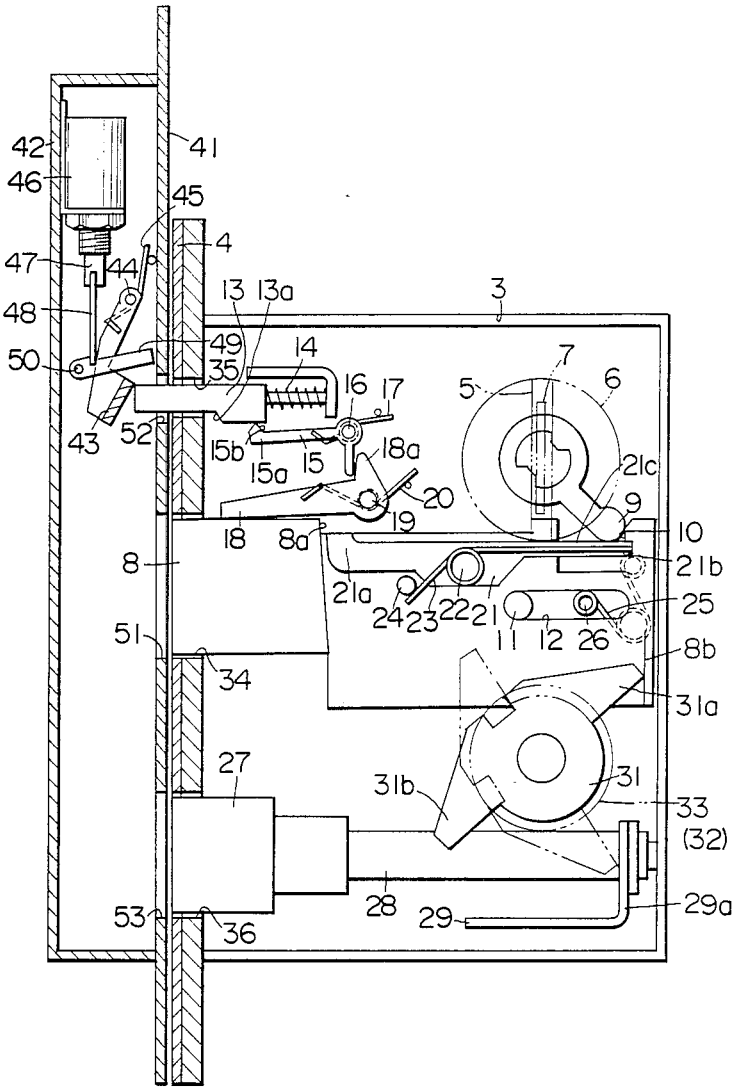

Next, the releasing operation performed electrically by remote control in the control room is explained as follows. When the solenoid 46 is powered-on, the plunger 47 is pulled upward. Consequently, as the lever 49 rotates counter-clockwise through the connection bar 48, the lever 43 is released from the engaging condition with the lever 49. At this time, since the restoration force of the compression spring 14 installed at the trigger bolt 13 is larger than the repulsive force of the spring 45 installed at the lever 43, the trigger bolt 13 pushes the lever 43 and rotates the same clockwise. Consequently, the trigger bolt 13 projects into the case 42 at the side of the strike 41 as shown in FIG. 4.

Next, when the trigger bolt 13 projects in such a way, the lever 15 rotates counter-clockwise by the sliding action of the inclined surface 13*a* of the trigger bolt 13 and the inclined surface 15*b* of the lever 15. At this time, another end portion 15*c* thereof presses one end portion 18*a* of the stop lever 18 and rotates the stop lever 18 clockwise. Thereby, the step portion 8*a* of the dead bolt 8 is released from the stop lever 18.

Next, by rotating the outer knob 33 clockwise, the rotating plate 31 also rotates clockwise and the lock device can be released by drawing in the dead bolt 8 into the case 3. Next, by rotating the outer knob 33 counter-clockwise the latch bolt 27 is drawn in into the case 3 and thereby the door 1 can be opened. After opening the door 1, the outer knob 33 is freed. At this time, the rotating plate 31 is restored to the original position by the repulsive force of the compression spring 30. As soon as the door 1 is opened, the pressing force applied to the press lever 43 from the trigger bolt 13 is released. Consequently, the press lever 43 rotates counter-clockwise by the repulsive force of the spring 45 and it is restored to the position shown in FIG. 1. At this time, the lever 49 rotates clockwise by the falling action of the plunger 47 and the connection bar 48 and it engages with the press lever 43. The engaging lever 49 is fixed in such a way. Therefore, when the door 1 is closed, the trigger bolt 13 is drawn in into the case 3 pressed by the lever 49.

In the case of locking the lock device, when the door is to be closed from the internal side, the thumbturn 5 is rotated counter-clockwise (clockwise viewing at from the external side). On the contrary, when the door is to be closed from the external side, the key 7 is inserted into the cylinder 6 and rotated clockwisely. In such a way, performance of locking the door is completed by the inverse action to the above-mentioned action.

Figure 5:
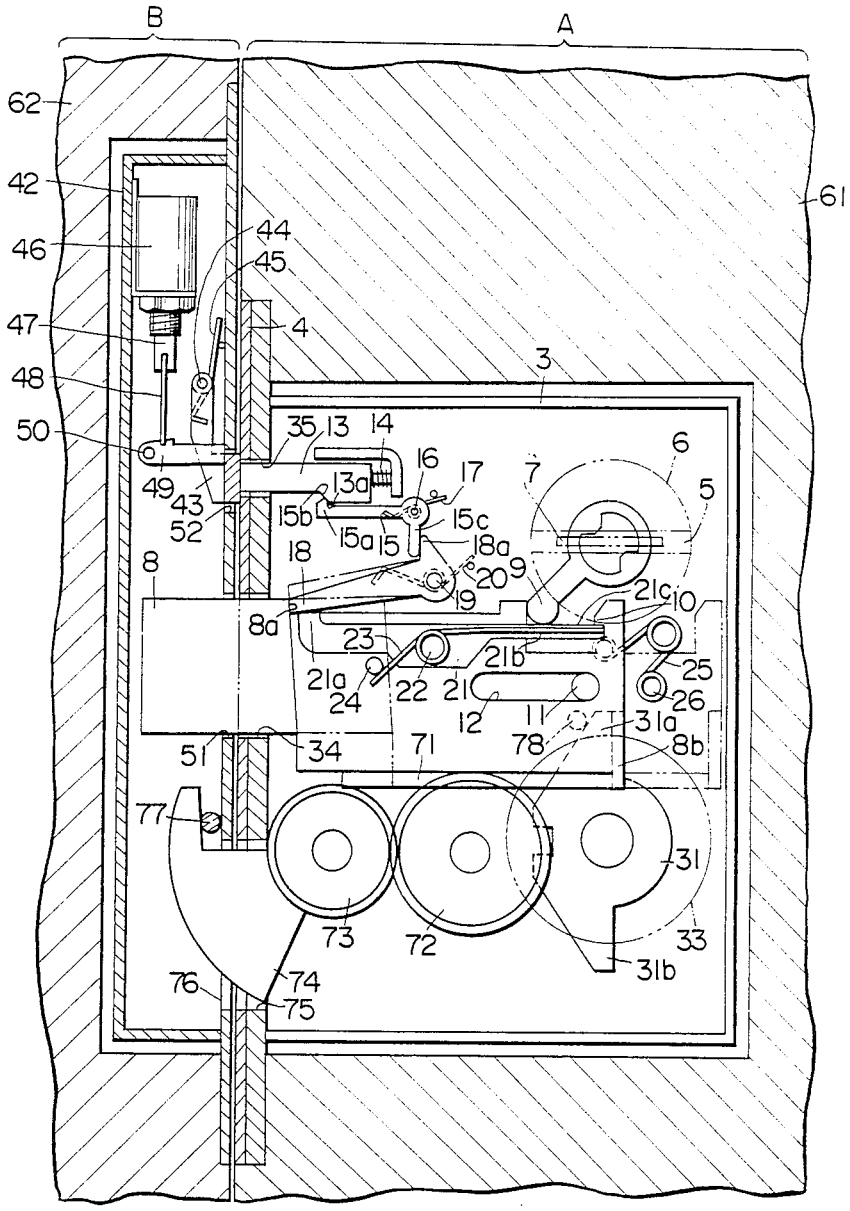
FIG. 5 is a partially broken side cross-sectional view showing another embodiment of the present invention.

FIG. 5 is a partially broken side cross-sectional view showing another embodiment of the present invention. This figure shows the embodiment in which the lock device of FIG. 1 is employed as a sliding door. In FIG. 5, the same reference numeral as that in FIG. 1 represents the same portion, 61 is a sliding door, 62 a doorcase of the sliding door such as framework or the like, 71 a rack formed below the dead bolt 8, 72 a pinion engaging with the rack 71, 73 a gear engaging with the pinion 72, 74 a sickle (L shaped lever) unitarily mounted on the gear 73 as a locking member, 75 and 76 through holes for inserting the sickle 74, and 77 a metal fixture for engaging with the sickle 74 at the time of locking the door. Means for locking and releasing the sickle 74 is formed in combination of the rack 71, the pinion 72, and the gear 73. In the same figure, 78 is an engaging projection provided on the dead bolt 8 in order to lock the door by the outer knob 33 without using key 7. When the rotating plate 31 rotates counter-clockwise, the engaging piece 31*a* is brought into direct contact with the engaging projection 78, and thereby the dead bolt 8 is caused to project in order to lock the door.

Furthermore, in the case of employing the lock device in the sliding device 61, there exists the external knob 33 only as the rotatable handle. Namely, since the dead bolt 8 and the sickle 74 are released at the same time by rotating the thumbturn from the internal side, it is not necessary to mount the rotatable inner knob 32 on the door. On this occasion, for instance a fixed lever-shaped handle (not shown in the drawing) is mounted on the sliding door 61 in order to open and close the same.

Next, the functional movement is explained hereinafter.

The trigger bolt 13 and the press lever 43 operate in the same manner as that of FIG. 1. So, the explanation thereof is omitted.

First of all, in the case of releasing the lock device from the internal side, the thumbturn 5 is rotated clockwise. On the contrary, in the case of the releasing the same from the external side, the key 7 is inserted into the cylinder 6 and rotated counter-clockwise. In such a manner, since the trigger bolt 13 releases the step portion 8*a* of the dead bolt 8 dead bolt 8 can be drawn in into the case 3. The pinion 72 rotates at the same time, and thereby the sickle 74 rotates counter-clockwise through the gear 73 and it is drawn in into the case 3. The releasing performance of the lock device is completed in such a way. Afterwards, the sliding door 61 is opened by pulling the fixed handle.

In the case of locking the door device from the internal side, the thumbturn 5 is rotated counter-clockwise. At this time, the dead bolt 8 projects from the external side, namely, from the position shown by the two-dots-and-dash line in FIG. 5 to the other position shown by the solid line in FIG. 5. The stop lever 18 is stopped on the step portion 8*a* and the sickle 74 rotates clockwise through the pinion 72 and the gear 73 and engages with the engaging metal fixture 77. The locking performance of the clock device is completed in such a way.

In the case of locking the lock device from the external side by use of the key 7, at first, the key 7 is inserted into the cylinder 6 and rotated counter-clockwise. At this time, the dead bolt 8 and the trigger bolt 13 are moved from the position shown by the two-dots-and-dash line in FIG. 5 to the other position shown by the solid line in FIG. 5. The lock device is locked in such a way.

Next, in the case of locking the lock device (from the external side) without using the key 7, the outer knob 33 is turned counter-clockwise and thereby the rotating plate 31 rotates also counter-clockwisely. At this time, the engaging piece 31*a* is brought into the direct contact with the engaging projection 78 and presses the projection 78. And then, the same moves the dead bolt 8 and the engaging lever 18 from the position shown by the two-dots-and-dash line in FIG. 5 to the other position shown by the solid line in FIG. 5. The lock device is locked in such a way.

Figure 6:
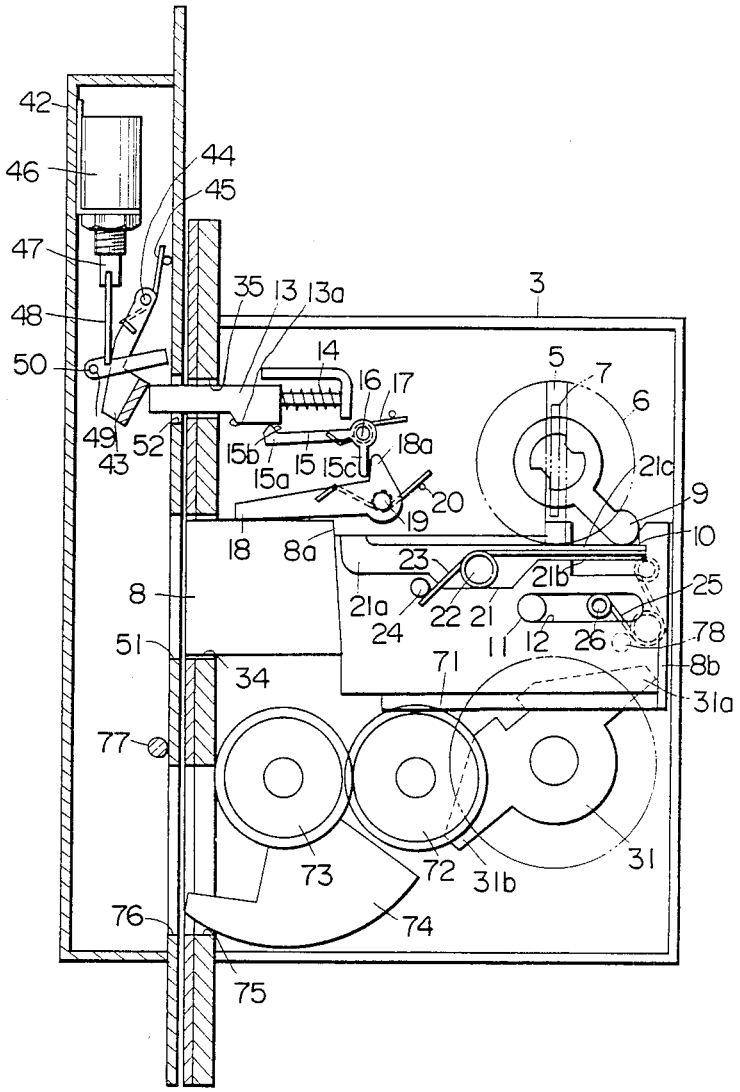
FIG. 6 is an explanation view showing the state after the operation shown in FIG. 5.

Next, when the visitor comes to the door, the lock device is electrically released by performing remote control in the control room as shown in FIG. 6. Namely, by the same action as that of FIG. 4, the trigger bolt 13 projects and the stop condition of the dead bolt 8 is released from the engaging step portion 8*a*.

Next, when the visitor rotates the outer knob 33 clockwisely, the rotating plate 31 rotates also clockwisely and draws in the dead bolt 8 into the case 3. The sickle 74 is drawn in into the case 3 at the same time through the pinion 72 and the gear 73. The lock device can be released in such a way.

And further, as shown in the lock device previously proposed by the present inventor (refer to the specification of Japanese Patent Publication No. 58-33348/1983), the thickness of one rotation lever of the above-mentioned lock device and that of one dead bolt thereof are respectively divided into two. An engaging means is provided between those divided two dead bolts and a detection means is provided for detecting the action of the respective dead bolts when those dead bolts project or retreat respectively. In such a construction, five kinds of informations as mentioned below can be electrically discriminated.

(1) Locking the lock device from the internal side;

(2) Locking the lock device from the external side;

(3) Locking the lock device from the internal side; and Releasing the lock device from the internal side;

(4) Locking the lock device from the external side; and Releasing the lock device from the external side; and (5) Locking the lock device from the internal side; and Releasing the lock device from the external side;

As is apparent from the foregoing description, the lock device according to the present invention comprises a locking portion and a fixing portion. The locking portion comprises a rotation lever mounted on the door side and turned by rotating a thumbturn from the internal side or turned by rotating a key from the external side, a dead bolt engaging with the rotation lever and performing lock and release of the lock device by turning the rotating lever, a trigger bolt for locking the dead bolt, a rotating plate having one end of an engaging piece engaging with the dead bolt and operating in a direction of drawing in the dead bolt to the door side by the action of rotation thereof, and a latch bolt engaging with another end engaging piece of the rotating plate drawn in to the door side by the action of rotation thereof. The fixing portion comprises a strike mounted on the frame side of the door, a pressing lever for locking the dead bolt by drawing in the same to the door side while pressing the trigger bolt onto the strike, means for causing the pressing lever to operate, and means for releasing press operation of the pressing lever and causing the trigger bolt to project to the door frame side. In such a construction as mentioned above, even though the dead bolt is locked, the lock condition of the trigger bolt is released by remote control and thereby the visitor can turn the outer knob from the external side. And then, after causing the dead bolt to drawn in, and further by releasing the lock member, the visitor can open the door.

I claim:

1. A locking device for locking a door in a door frame comprising a locking portion on said door and a fixing portion on said door frame, said locking portion comprising a rotation lever means rotatably mounted on said door, a dead bolt moveable in said door between a locked and an unlocked position, said rotation lever means being engageable with said dead bolt to move said dead bolt from its locked to its unlocked position, a rotating plate means rotatably mounted on said door and rotatable in one direction to engage and move said dead bolt from its locked to its unlocked position, a latch means moveably mounted on said door between a latched and an unlatched position, said rotating plate means being engageable with said latch means to move said latch means from said latched to said unlatched position, a trigger bolt means mounted on said door for movement between a trigger-locked and a trigger-released position, said trigger bolt means in said trigger-locked position locking said dead bolt in its locked position, said trigger bolt means in said trigger-release position releasing said dead bolt so that said dead bolt is moveable from its locked to its unlocked position, said fixing portion comprising a pressing-operable means mounted on said door frame and moveable between an engaged position and a released position, said pressing-operable means when in said engaged position and with the door closed being engageable with said trigger bolt means to maintain said trigger bolt means in said trigger-locked position, said pressing-operable means when in said released position and with the door closed being operable to release said trigger bolt means to its trigger-release position so that the door can be opened.

2. A locking device according to claim 1 further comprising operable lever means mounted on said dead bolt and operable by said rotation lever means to release said trigger bolt means to said trigger-release position so that the door can be opened.

3. A locking device according to claim 2, wherein said rotation lever means is rotatable to a first position to engage said operable lever means to effect release of said trigger bolt means to said trigger-release position, said rotation lever means being further rotatable from said first position to a second position to engage and move said dead bolt from its locked to its unlocked position.

4. A locking device according to claim 2, wherein said operable lever means comprises an operable lever pivotably mounted on said dead bolt, said operable lever having one lever portion engageable by said rotation lever means and another lever portion which releases said trigger bolt means.

5. A locking device according to claim 1 further comprising an operation lever pivotably mounted on said dead bolt, said operating lever having a lever-locked position which maintains said trigger bolt means in said trigger-locked position and a lever-release position which releases said trigger bolt means to its trigger-release position, said rotation lever means being moveable from a closed position to an open position such that when in said closed position and with the door closed, said operating lever is in said lever-locked position and said trigger bolt means is in said trigger-locked position, said rotation lever means upon being moved from its closed position to its open position with the door closed being operable to move said operating lever to its lever-release position which in turn releases said trigger bolt means to said trigger-release portion so that the door can be opened.

6. A locking device according to claim 1, wherein said pressing-operable means comprises remote-control means for effecting operation of said pressing-operable means from its engaged to its released position.

7. A locking device according to claim 1, wherein said pressing-operable means comprises a moveable lever, and electrically-operated means for effecting movement of said pivotal lever.

8. A locking device according to claim 1, wherein said trigger bolt means comprises a trigger bolt moveable between said trigger-locked and said trigger-release position, said trigger bolt when in said trigger-locked position being disposed within said door, said trigger bolt when in said trigger-release position projecting into said door frame.

9. A locking device according to claim 8, wherein said trigger bolt means further comprises biasing means biasing said trigger bolt toward said trigger-release position such that when said pressing-operable means is moved to its released position, said biasing means biasingly urges said trigger bolt to said trigger-release position.

10. A locking device according to claim 8, wherein said trigger bolt means further comprises spring-biased lever means operable between said trigger bolt and said dead bolt.

11. A locking device according to claim 1, wherein said rotation lever means comprises a key-receiving means facing the outside of the door for receiving a key to effect rotation of said rotation lever means, said rotation lever means further comprising a thumbturn facing the inside of the door to effect rotation of said rotation lever means.

12. A locking device according to claim 1, wherein said rotating plate means comprises a rotating plate along with an inner knob on the inside of the door and an outer knob on the outside of the door such that rotating said inner and outer knobs rotates said rotating plate.

13. A locking device according to claim 1, wherein said rotating plate means comprises a knob which is rotatable to move said dead bolt to said unlocked position and to move said latch means to said unlatched position when said pressing-operable means is in said released position and has released said trigger bolt means to its trigger release position.

14. A locking device according to claim 13, wherein said knob is rotated in one direction to move said dead bolt to said unlocked position and rotated in an opposite direction to move said latch means to said unlatched position.

15. A locking device according to claim 1, wherein said latch means comprises a latch member slidably mounted on said door.

16. A locking device according to claim 1, wherein said latch means comprises a latch member rotatably mounted on said door.

17. A locking device for locking a door in a door frame comprising a locking portion on said door and a fixing portion on said door frame, said locking portion comprising a rotation lever means rotatably mounted on said door, a dead bolt moveable in said door between a locked and an unlocked position, said rotation lever means being operable to move said dead bolt from its locked to its unlocked position, a rotating plate means rotatably mounted on said door and rotatable in one direction to engage and move said dead bolt from its locked to its unlocked position, a latch means moveably mounted on said door between a latched and an unlatched position, said rotating plate means being operable to move said latch means from said latched to said unlatched position, a trigger bolt means mounted on said door for movement between a trigger-locked and a trigger-released position, said trigger bolt means in said trigger-locked position locking said dead bolt in its locked position, said trigger bolt means in said trigger-release position releasing said dead bolt so that said dead bolt is moveable from its locked to its unlocked position, said fixing portion comprising a pressing-operable means mounted on said door frame and moveable between an engaged position and a released position, said pressing-operable means when in said engaged position being operable to maintain said trigger bolt means in said trigger-locked position, said pressing-operable means when in said released position being operable to release said trigger bolt means to its trigger-release position so that the door can be opened.

* * * * *